United States Patent [19]

Hayes

[11] Patent Number: 4,913,205

[45] Date of Patent: Apr. 3, 1990

[54] CONTINUOUSLY MOVING LATHE KNIFE

[76] Inventor: Leonard L. Hayes, 16820 S.W. Inverurie, Lake Oswego, Oreg. 97035

[21] Appl. No.: 295,269

[22] Filed: Jan. 9, 1989

Related U.S. Application Data

[63] Continuation-in-part of Ser. No. 140,732, Jan. 4, 1988, Pat. No. 4,796,681.

[51] Int. Cl.[4] ..... B27L 1/00

[52] U.S. Cl. ..... 144/212; 83/801; 83/820; 144/209 R; 144/241; 144/365

[58] Field of Search ..... 144/209 R, 212, 213, 144/218, 241, 365; 83/794, 801, 820

[56] References Cited

U.S. PATENT DOCUMENTS 4,796,681 1/1989 Hayes ..... 144/212

*Primary Examiner*—W. Donald Bray

*Attorney, Agent, or Firm*—Zarley McKee, Thomte, Voorhees & Sease

[57] ABSTRACT

A continuously moving lathe knife is provided which can be retrofit to an existing lathe carriage. The knife assembly includes a chain bar secured to the knife carriage with a pair of sprockets at either end of the chain bar. An endless loop chain extends around the sprockets. The chain includes knife tips with angularly disposed serrations which engage the surface of the log from which veneer is being cut. As the log is rotated about its longitudinal axis, the friction between the log and knife tip serrations imparts longitudinal movement of the chain with respect to the log. The chain thereby moves around the chain bar so as to cut a layer of veneer from the log. No separate power source is required for rotating the chain.

15 Claims, 1 Drawing Sheet

CONTINUOUSLY MOVING LATHE KNIFE

This application is a continuation-in-part of applicant's co-pending application, Ser. No. 140,732 filed Jan. 4, 1988, to be issued Jan. 10, 1989 as U.S. Pat. No. 4,796,681.

BACKGROUND OF THE INVENTION

Conventional lathe knives used in cutting sheets of wood veneer from a log utilize an oscillating blade to cut the veneer, such as that described in applicant's previous U.S. Pat. No. 3,381,727 issued May 7, 1968. Other lathes use a fixed blade which is forced through the wood to cut the veneer. These prior art lathes have problems associated with the limited movement of the knife or blade, including the high frictional forces, which are developed between the blade and the log, which requires greater power to turn the log and limits the speed of the cutting operation. Furthermore, those lathes produce wood splitting, grain rolling, roughness, and low quality due to the oscillating or fixed blade.

Therefore, a primary objective of the present invention is to provide a lathe knife which continuously moves transversely to the log so as to produce a high quality sheet of veneer.

A further objective of the present invention is the provision of a lathe knife having serrations therein which impart transverse movement to the knife relative to the log due to the friction between the knife and log as the log rotates.

Another objective of the present invention is the provision of a continuously moving lathe knife which can be retro-fit upon existing lathe carriages.

Another objective of the present invention is the provision of a continuously moving lathe knife which produces a shearing or slicing action so as to produce a clean cut for the veneer.

Still a further objective of the present invention is the provision of a lathe knife which moves continuously transverse to the log so as to cut through knots and fibers.

Yet another objective of the present invention is the provision of a continuously moving lathe knife which is self cleaning.

A further object of the present invention is the provision of a continuously moving lathe knife which has replaceable knife tips.

Another objective of the present invention is the provision of a continuously moving lathe knife which is economical to manufacture, and durable and safe in use.

These and other objectives will become apparent from the following description of the invention.

SUMMARY OF THE INVENTION

A lathe machine is provided for cutting sheets or layers of veneer from a wooden log. The machine includes a frame with chucks for rotatably supporting and rotating an elongated wooden log on its center axis. A knife carriage is moveably mounted on the frame and is moved towards and away from the log by hydraulics.

A chain saw type assembly is fixed on the frame for cutting the veneer from the log. The chain saw assembly includes a chain bar secured to the knife carriage and having a channel extending around the chain bar. An endless-loop chain formed from a plurality of pivotably connected chain links moveably extends through the chain bar channel. The chain includes at least one guide link and central stabilizer link, which are pinned together. The guide links are tracked in the chain bar channel and the stabilizer link is received in a deeper annular groove which is in communication with the channel. Each guide link has a knife tip for cutting the veneer from the wood as the chain rotates around the sprocket and chain bar. The chain is driven by angular serrations in the knife tips which frictionally engage the rotating log.

DETAILED DESCRIPTION OF THE DRAWINGS

Figure 1:
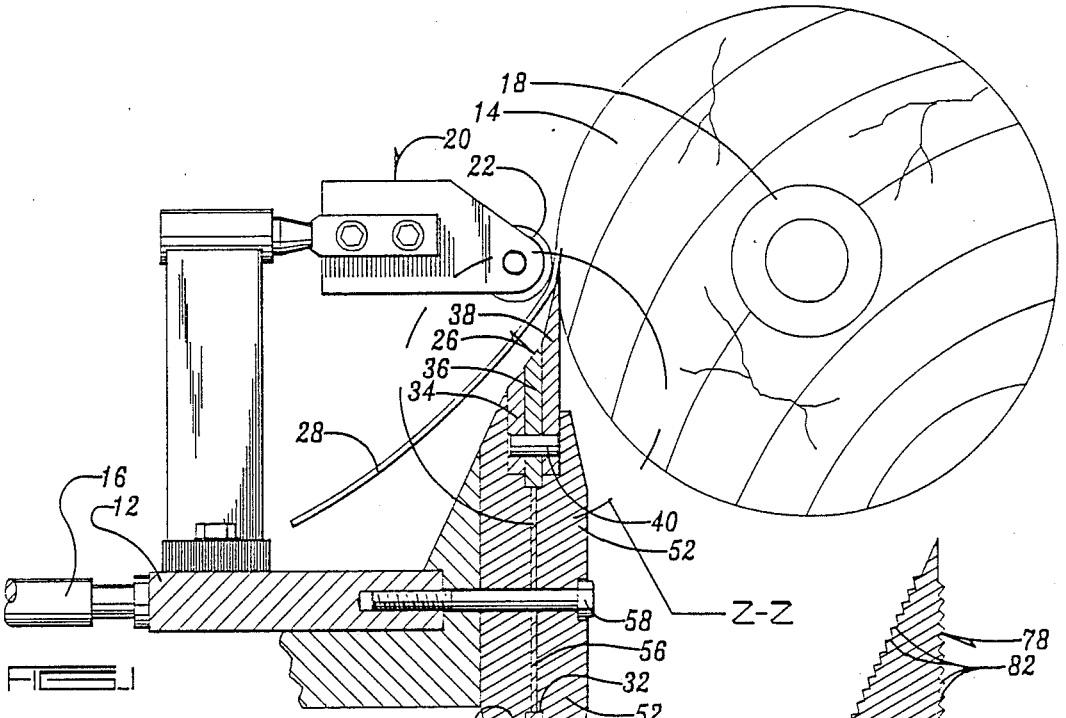
FIG. 1 is a sectional view of the continuously moving lathe knife of the present invention.

The continuously moving lathe knife of the present invention is generally designated by the reference numeral 10 in the drawings. This knife is adapted to be retro-fit on an existing lathe carriage 12 which is adapted to be moved towards and away from a wooden log 14 by hydraulic system 16. The log 14 is rotatably mounted on chucks 18 so as to be rotatable about its longitudinal center axis. Lathe carriage 12 also includes an adjustable depth gauge 20 having a roller 22 thereon for applying constant pressure on the log and thereby maintaining a constant thickness of the veneer being cut by the knife.

Lathe knife 10 includes a chain bar 24 with an endless loop chain 26 which rotates around the chain bar so as to cut a layer of veneer 28 from the wood log 14. More particularly, chain bar 24 includes a channel 30 with a deeper annular groove 32 in communication therewith. Chain 26 is formed from a plurality of pivotably connected links, including an inner guide link 34, and an intermediate stabilizer link 36 and an outer guide link 38. Links 34, 36, 38 are interconnected by connecting pins 40. The stabilizer links 36 are offset with respect to the guide links 34, 38 so that the guide links are pivotal with respect to the stabilizer link. Each outer guide link 38 has a sharp knife tip 39 for cutting the veneer layer from the log. The upper edges of links 34, 36, and 38 are beveled to provide a receiving or slide surface for the veneer. A honing device (not shown) can be provided on lathe knife 10 to keep knife tips 39 sharp.

Figure 2:
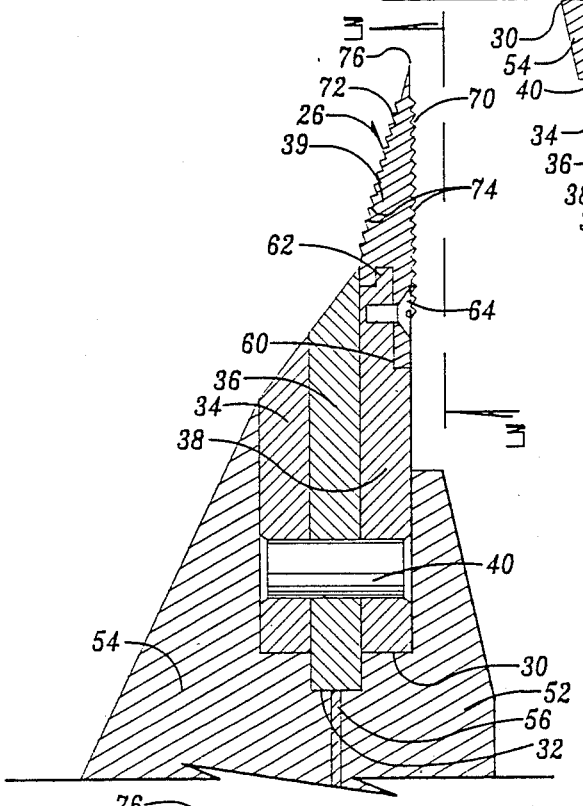
FIG. 2 is an enlarged sectional view, taken along lines 2—2 of FIG. 1 of the serrated knife tip of the present invention.

Each knife tip 39 can be integrally formed with the respective outer guide link 38 or can be replaceably secured to guide link 38 by means of a set screw 64, as seen in FIG. 2.

Channel 39 provides a guide track for guide links 34, 38 while annular groove 32 provides a guide track for stabilizing link 36. A pair of idler sprockets 42 are positioned at opposite ends of the chain bar 24. Both sprockets include pairs of spaced-apart teeth 44 extending around the perimeter of the sprocket. These teeth 44 are adapted to be received in recesses 46, 48 in guide links 34, 38, respectively. The space between teeth 44 defines a groove 50 in which stabilizer link 36 is received. Accordingly, chain 26 is trained around chain bar 24, with the stabilizer links 36 received in the annular groove 32 and groove 50 in the sprockets. Guide links 34 and 38 are guided by the walls of channel 30 and teeth 44 on the sprockets.

Chain bar 24 is comprised of first and second elongated plates 52 and 54, with a shim member 56 positioned therebetween, as seen in FIG. 1. A bolt or other fastening means 58 secures the plates 52, 54 to the lathe carriage 12. Shim 56 can be replaced with other shims having various thicknesses such that the width of channel 30 and annular groove 32 can be adjusted. Accordingly, the tracking tension on chain 26 can be varied as necessary. Also, the friction from the operation of the lathe knife 10 will eventually require the width of channel 30 and annular groove 32 to be decreased to account for wear on chain bar 24 and chain 26. Furthermore, chains having different width can be accommodated, for example heavy-duty and lightweight chains.

Knife tips 39 have a front surface 70 and a rear surface 72, both of which include serrations or knurls 74. The serrations are angled with respect to the cutting edge 76 of the knife tip.

Figure 4:
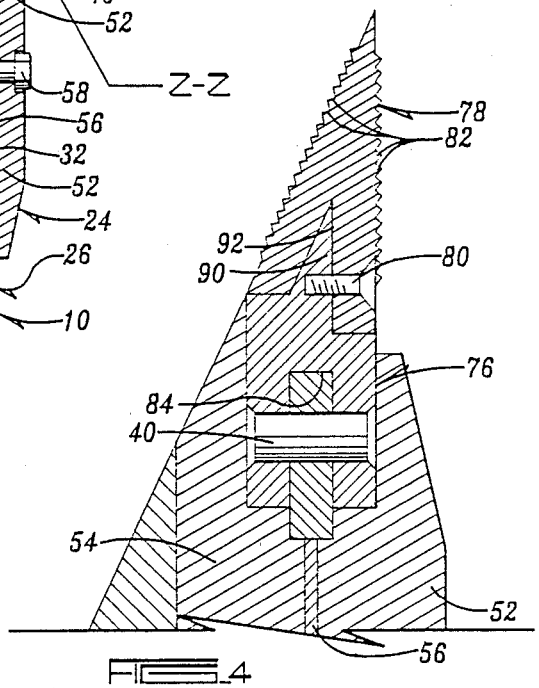
FIG. 4 is a perspective view of an alternative embodiment of a guide link with a serrated knife tip.
Figure 3:
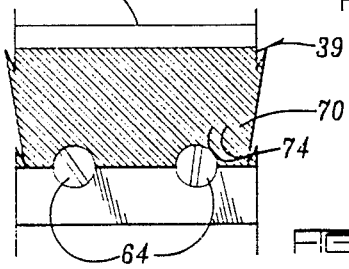
FIG. 3 is a partial front elevational view, taken along lines 3—3 of FIG. 1, showing the knife tip serrations.
Figure 5:
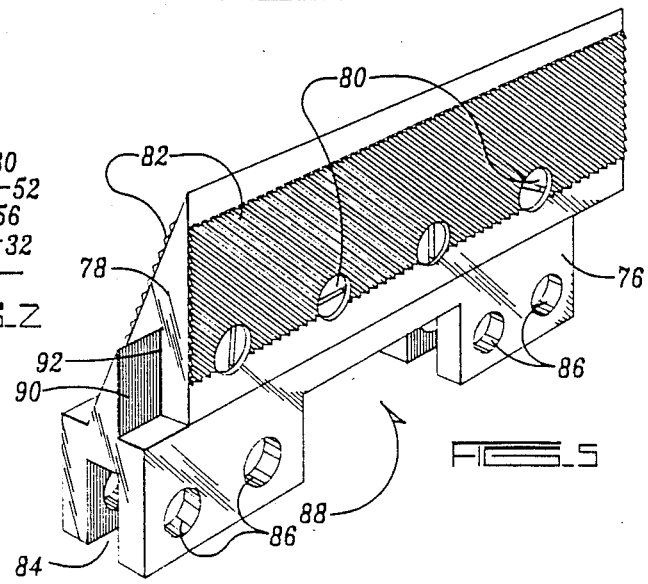
FIG. 5 is an enlarged sectional view, similar to FIG. 2, of the alternative embodiment of the serrated knife tip.

In an alternative embodiment, shown in FIGS. 4 and 5, inner and outer guide links 34 and 36 are replaced by a single U-shaped guide link 76, which has a knife tip 78 mounted thereon by set screws 80. The front and rear surfaces of knife tip 78 have angularly disposed serrations or knurls 82. Guide link 76 has a channel 84 which is adapted to receive the stabilizer link 36. Link 76 has holes 86 for receiving a pin 40 to secure the link to stabilizer link 36. Link 76 also has a transverse notch 88 extending across the width thereof which facilitates movement of the link around sprocket 42 and which also allows sawdust and other accumulated waste materials to fall or be blown away from the link.

FIG. 4 shows that knife tip 78 is longitudinally offset with respect to link 76. This provides additional stability between adjacent links 76 as the male portion 90 of one link is received in the female portion 92 of a longitudinally adjacent knife tip 78.

In operation, a power source is actuated to rotate log 14 about its longitudinal axis. As the log rotates in engagement with the cutting edge of the knife tip 39 or 78, the veneer layer 38 is cut from the log. Also, the engagement of log surface and veneer layer with the serrations on the knife tip causes the chain to move longitudinally with respect to the log. Thus, the chain revolves around the sprockets and within the guide bar channel due to the presence of the serrations in the knife tips, without the need of a separate power source for driving the sprockets. The speed of the chain is dependent upon the angle of the serrations.

While the serrations frictionally engage the log surface and the veneer surface, no permanent damage is caused to these surfaces due to the resiliency thereof. In other words, while the serrations temporarily indent the surfaces, the surface is not ruptured and will return to a smooth condition in a short amount of time.

As the veneer is cut, hydraulic system 16 advances carriage 12 towards the axis of log 14 to account for the decreasing diameter of the log. Depth gauge 20 maintains a constant pressure on the surface of the log so that the veneer thickness remains constant. The spacing between the surface of roller 22 and knife tips 29 or 78 can be adjusted so that the thickness of the veneer can be adjusted.

While the term "wood veneer" is used in the description and in the claims, it is understood that materials other than wood can be veneered, without departing from the spirit or scope of this invention.

Accordingly, a lathe knife is provided which provides a clean-cut, unblemished veneer. Thus, at least all of the stated objectives are accomplished by the lathe knife of the present invention.

What is claimed is:

1. A machine for cutting veneer layers from a log, comprising,
   - a frame;
   - means for rotatably supporting and rotating a cylindrical elongated log on its longitudinal center axis;
   - a knife carriage on said frame;
   - a chain bar on the knife carriage;
   - a chain channel extending around said chain bar;
   - a continuous chain comprising a plurality of pivotally connected chain links movably extending through said channel, each chain link including a knife tip with a cutting edge; and
   - each knife tip having serrations therein for engaging the log, the serrations being angularly disposed with respect to the cutting edge of the knife tips and being adapted to frictionally engage the surface of the log, whereby upon rotation of said log, the frictional engagement between the log and serrations imparts longitudinal movement of the chain with respect to the log such that said chain rotates around said chain bar and within said channel to cut a layer of veneer from said log.

2. The machine of claim 1 wherein the serrations are angled approximately 30° with respect to the cutting edge of the knife tips.

3. The machine of claim 1 wherein the knife tips have front and rear surfaces, with the serrations being on both surfaces.

4. The machine of claim 1 wherein the knife tips are removably secured to the links.

5. The machine of claim 1 further comprising an annular groove in said chain bar in communication with said channel and wherein said chain includes a stabilizing link secured to each of said pivotally connected links and being slidably mounted in said annular groove.

6. The machine of claim 5 wherein each link has an elongated groove extending along its length adapted to receive the stabilizing link.

7. The machine of claim 5 wherein the distance from the inner to the outer ends of said stabilizing link is approximately four inches.

8. The machine of claim 1 wherein said chain includes an outer guide link, a middle stabilizer link, and an inner guide link, and pin means for securing said links together, said stabilizer link being longitudinally offset with respect to said guide links such that said pin means pivotally connect each stabilizer link to adjacent outer guide links and to adjacent inner guide links.

9. The machine of claim 8 wherein said chain bar includes an annular groove in communication with said channel, said guide links being slidably received in said channel and said stabilizer links being slidably received in said annular groove.

10. The machine of claim 8 wherein said knife tips are on said outer guide links.

11. The machine of claim 8 wherein further including sprockets rotatably mounted at opposite ends of said chain bar, said chain being trained around said sprockets.

12. The machine of claim 11 wherein said sprockets include pairs of spaced apart teeth extending around the perimeter of said sprockets for matingly engaging recesses in said inner and outer guide links and said stabilizer links being received in the space between said pairs of teeth.

13. The machine of claim 8 wherein each of said links includes a beveled upper edge to provide a slide surface for the veneer.

14. The machine of claim 1 wherein said chain bar includes a pair of chain bar plates with shim means therebetween and means for securing said plates and shim means to said knife carriage, said shim means permitting for adjustment of the width of said chain channel.

15. The machine of claim 1 further comprising an adjustable depth gauge for controlling the depth of cut into said log and thereby the thickness of said veneer.

* * * * *